US011958101B2

(12) United States Patent
Shouji et al.

(10) Patent No.: US 11,958,101 B2
(45) Date of Patent: Apr. 16, 2024

(54) METHOD FOR MANUFACTURING FORGED ARTICLE

(71) Applicants: Proterial, Ltd., Tokyo (JP); TOYOTA JIDOSHA KABUSHIKI KAISHA, Aichi (JP); DAIDO CHEMICAL CO., LTD., Osaka (JP); UMETOKU CO., LTD, Osaka (JP)

(72) Inventors: Tatsuya Shouji, Tokyo (JP); Shuho Koseki, Tokyo (JP); Kenichi Inoue, Tokyo (JP); Katsuhiro Obata, Tokyo (JP); Satoshi Murakami, Tokyo (JP); Naoki Hayashi, Aichi (JP); Yoshikazu Suzuki, Aichi (JP); Toshifumi Miyamoto, Aichi (JP); Toru Otomo, Aichi (JP); Nobuhiro Ikeda, Nara (JP); Kousuke Uda, Nara (JP); Takashi Ogisu, Aichi (JP)

(73) Assignees: PROTERIAL, LTD., Tokyo (JP); TOYOTA JIDOSHA KABUSHIKI KAISHA, Aichi (JP); DAIDO CHEMICAL CO., LTD., Osaka (JP); UMETOKU CO., LTD, Osaka (JP)

( * ) Notice: Subject to any disclaimer, the term of this patent is extended or adjusted under 35 U.S.C. 154(b) by 743 days.

(21) Appl. No.: 17/056,746

(22) PCT Filed: May 16, 2019

(86) PCT No.: PCT/JP2019/019468
§ 371 (c)(1),
(2) Date: Nov. 18, 2020

(87) PCT Pub. No.: WO2019/225464
PCT Pub. Date: Nov. 28, 2019

(65) Prior Publication Data

US 2021/0245233 A1 Aug. 12, 2021

(30) Foreign Application Priority Data

May 22, 2018 (JP) ..... 2018-097711

(51) Int. Cl.
*B21J 3/00* (2006.01)
*B21J 13/02* (2006.01)
(Continued)

(52) U.S. Cl.
CPC ..... *B21J 3/00* (2013.01); *B21J 13/02* (2013.01); *C22C 38/001* (2013.01); *C22C 38/02* (2013.01);
(Continued)

(58) Field of Classification Search
CPC ..... B21J 1/003; B21J 3/00; B21J 5/025; B21J 13/02
See application file for complete search history.

(56) References Cited

U.S. PATENT DOCUMENTS 3,712,157 A * 1/1973 Kratz ..... B21K 5/20 72/359
5,985,428 A 11/1999 Chiba
(Continued)

FOREIGN PATENT DOCUMENTS

JP H10219421 A 8/1998
JP 2001316795 A 11/2001
JP 2002239671 A 8/2002

OTHER PUBLICATIONS

JP 2003-268486A, Yoshida et al. Sep. 2003.*
(Continued)

*Primary Examiner* — Edward T Tolan
(74) *Attorney, Agent, or Firm* — McCoy Russell LLP

(57) ABSTRACT

A method for manufacturing a forged article, capable of improving the durability of a die for forging is provided. The
(Continued)

method, includes forging a steel material, by using a die, by spraying or applying a water-soluble polymer lubricant containing 0.01 to 0.98 mass % of a water-soluble sulfate onto a working surface of the die, the die being made of a raw material having a constituent composition of by mass %, of 0.4 to 0.7% of C, 1.0% or less of Si, 1.0% or less of Mn, 4.0 to 6.0% of Cr, 2.0 to 4.0% of (Mo+½W), 0.5 to 2.5% of (V+Nb), 0 to 1.0% of Ni, 0 to 5.0% of Co, 0.02% or less of N, and a remnant composed of Fe and impurities, and having hardness of 55 to 60 HRC, and the die including a nitrided layer or a nitrosulfidized layer on the working surface thereof.

4 Claims, 6 Drawing Sheets

(51) Int. Cl.

| | |
|---|---|
| ***C22C 38/00*** | (2006.01) |
| ***C22C 38/02*** | (2006.01) |
| ***C22C 38/44*** | (2006.01) |
| ***C22C 38/46*** | (2006.01) |
| ***C22C 38/48*** | (2006.01) |
| ***C22C 38/52*** | (2006.01) |
| ***C22C 38/58*** | (2006.01) |

(52) U.S. Cl.
CPC ..... *C22C 38/44* (2013.01); *C22C 38/46* (2013.01); *C22C 38/48* (2013.01); *C22C 38/52* (2013.01); *C22C 38/58* (2013.01)

(56) References Cited

U.S. PATENT DOCUMENTS

| | | | | |
|---|---|---|---|---|
| 8,507,416 | B2 * | 8/2013 | Hatasaki | C10M 173/02 508/176 |
| 10,077,490 | B2 * | 9/2018 | Valls | C22C 38/54 |
| 10,494,688 | B2 * | 12/2019 | Nakano | C21D 8/005 |
| 11,319,621 | B2 * | 5/2022 | Kawano | C22C 38/20 |
| 2007/0245799 | A1 * | 10/2007 | Asakawa | B21K 5/20 72/356 |
| 2014/0373593 | A1 * | 12/2014 | Toga | B21J 5/08 72/352 |
| 2015/0144233 | A1 * | 5/2015 | Park | B29C 33/38 72/352 |

OTHER PUBLICATIONS

CN 10654459A, Zuo et al. Mar. 2017.*
CN 101568396A, Yoshihiro et al. Oct. 2009.*
JP 2000-063880A, Imai et al. Feb. 2000.*

* cited by examiner

METHOD FOR MANUFACTURING FORGED ARTICLE

CROSS REFERENCE TO RELATED APPLICATIONS

The present application is a U.S. National Phase of International Application No. PCT/JP2019/019468 entitled "METHOD FOR MANUFACTURING FORGED ARTICLE," and filed on May 16, 2019. International Application No. PCT/JP2019/019468 claims priority to Japanese Patent Application No. 2018-097711 filed on May 22, 2018. The entire contents of the above-listed applications are hereby incorporated by reference for all purposes.

TECHNICAL FIELD

The present invention relates to a method of manufacturing a forged article.

BACKGROUND AND SUMMARY

Conventionally, when a forged article such as a component for an automobile is manufactured by performing warm or hot forging for a steel material, various types of hot tool steels or high-speed tool steels are used as a raw material for a die used for the warm or hot forging. Further, in the case of the high-speed tool steel, the so-called "matrix high-speed steel", which has a constituent composition in which the content of carbide-forming elements is reduced and hence has the reduced amount of carbide in the structure, is effective for improving the durability of the die for warm or hot forging because it has high hardness and exhibits excellent toughness during the warm or hot forging.

Further, in order to improve the durability of the die for warm or hot forging, it is effective to perform various types of surface treatments on the working surface thereof (i.e., the surface that comes into contact with a steel material (a material to be forged) during the warm or hot forging). A typical example of these surface treatments is a nitriding treatment. Further, among them, a nitrosulfidizing treatment in which a nitrided layer containing iron sulfide is formed on the working surface of a die by using various nitrogen/sulfur supply sources as treatment mediums makes it possible to impart an excellent abrasion resistance and an excellent seizing resistance to the working surface of the die for warm or hot forging (Patent Literatures 1 and 2).

CITATION LIST

Patent Literature

Japanese Unexamined Patent Application Publication No. H10-219421

Japanese Unexamined Patent Application Publication No. 2002-239671

Technical Problem

The techniques disclosed in Patent Literatures 1 and 2 are effective for improving the durability of a die for warm or hot forging. However, in recent warm or hot forging, there is a tendency that, because of complex shapes and/or near net shapes or the like of forged articles manufactured by the warm or hot forging, larger loads are exerted on working surfaces during the forging. For example, larger frictional heat is generated on working surfaces (working surfaces have higher temperatures) during the forging. Therefore, it has been desired to improve the durability of a die for warm or hot forging even further.

An object of the present invention is to provide a method for manufacturing a forged article, capable of improving the durability of a die for warm or hot forging.

Solution to Problem

The present inventors have focused attention on a "lubricant" that is sprayed or applied onto the working surface of a die during warm or hot forging in order to suppress the above-described increase in frictional heat. Then, the present inventors have found that when a raw material for a die for warm or hot forging is optimized, there is an optimum combination of a surface treatment layer formed on the working surface of the die for warm or hot forging, which is made of the optimized raw material, and the above-described lubricant, and have achieved the present invention.

That is, the present invention provides a method for manufacturing a forged article, including warm or hot forging a steel material, by using a die, by spraying or applying a water-soluble polymer lubricant containing 0.01 to 0.98 mass % of a water-soluble sulfate onto a working surface of the die, the die being made of a raw material having a constituent composition of, by mass %, 0.4 to 0.7% of C, 1.0% or less of Si, 1.0% or less of Mn, 4.0 to 6.0% of Cr, 2.0 to 4.0% of a relational expression of (Mo+½W) containing one or both of W and Mo, 0.5 to 2.5% of a relational expression of (V+Nb) containing one or both of V and Nb, 0 to 1.0% of Ni, 0 to 5.0% of Co, 0.02% or less of N, and a remnant composed of Fe and impurities, and having hardness of 55 to 60 HRC, and the die including a nitrided layer or a nitrosulfidized layer on the working surface thereof.

Further, the present invention preferably provides the above-described method for manufacturing a forged article, in which the water-soluble polymer lubricant is sprayed or applied onto the working surface of the die preheated to 150 to 400° C.

In the above-described die, the nitrided layer or the nitrosulfidized layer on the working surface thereof is preferably formed by a salt-bath method. Further, in the above-described die, a compressive residual stress of −400 MPa or weaker is preferably applied to a part thereof located at a depth of 30 μm from its working surface.

Advantageous Effects of Invention

According to the present invention, it is possible, when a steel material is warm-and-hot forged, to improve the durability of a die used for the warm or hot forging.

DETAILED DESCRIPTION

Figure 1:
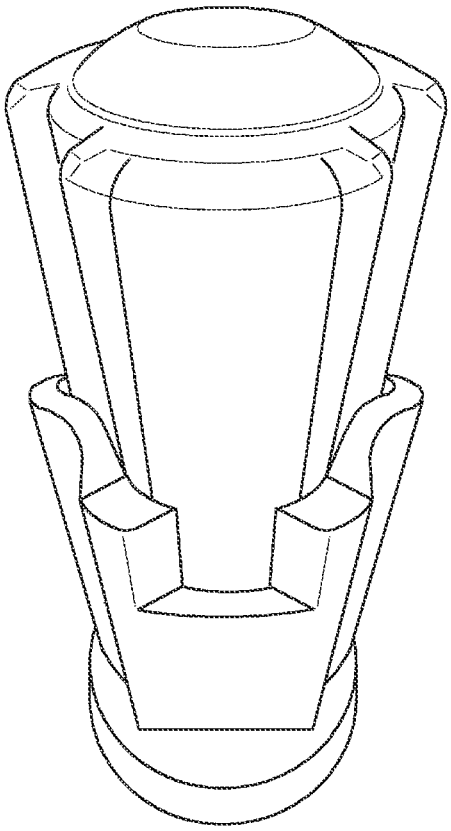
FIG. 1 is a drawing showing an example of an external appearance of a working surface of a die for warm or hot forging before it is used.

A feature of the present invention lies in that the durability of a die for warm or hot forging can be improved by adopting a combination of a feature that the raw material of the die for warm or hot forging is limited to "matrix high-speed steel" having a predetermined constituent composition and a surface treatment layer formed on the working surface of the die is a "nitrided layer" or a "nitrosulfidized layer", with a feature that a lubricant used during the warm or hot forging is a "water-soluble polymer lubricant containing 0.01 to 0.98 mass % of a water-soluble sulfate". Note that the warm or hot forging means forging that is performed by heating a steel material to be forged to approximately 700 to 1,300° C. Each of the components/requirements of the present invention will be described hereinafter.

In the present invention, a die used for warm or hot forging is made of a raw material having a constituent composition of, by mass %, 0.4 to 0.7% of C, 1.0% or less of Si, 1.0% or less of Mn, 4.0 to 6.0% of Cr, 2.0 to 4.0% of a relational expression of (Mo+½W) containing one or both of W and Mo, 0.5 to 2.5% of a relational expression of (V+Nb) containing one or both of V and Nb, 0 to 1.0% of Ni, 0 to 5.0% of Co, 0.02% or less of N, and a remnant composed of Fe and impurities, and having hardness of 55 to 60 HRC.

In the present invention, to begin with, it is important to select a raw material for a die for warm or hot forging in order to improve the durability of the die. That is, it is a raw material capable of, in addition to achieving hardness high enough to impart a sufficient tensile strength to the die in use, maintaining excellent toughness in its high-hardness state. Further, in particular, in the present invention, a lubricant is actively used to maintain the lubricity of the working surface of the die as will be described later. Therefore, since the method for manufacturing a forged article according to the present invention is carried out in an environment in which the die is quickly cooled by the lubricant and hence cracks are likely to occur in the die, it is necessary to select, as the raw material for the die, "matrix high-speed steel" having toughness excellent enough to prevent the above-described cracks from occurring in the die. Requirements (a constituent composition and hardness) of a raw material for a die according to the present invention will be described hereinafter.

C: 0.4 to 0.7%

C combines with carbide-forming elements such as Cr, Mo, W, V and Nb, and thereby forms hard double carbide, thus imparting an abrasion resistance required for the die for warm or hot forging. Further, a part of C is solid-dissolved in the matrix and thereby strengthens the matrix. Further, it imparts hardness to a martensitic structure after hardening and tempering. However, an excessive amount of C causes segregation of carbide. Therefore, C is 0.4 to 0.7%. It is preferably 0.45% or more, and more preferably 0.5% or more. It is preferably 0.65% or less, and more preferably 0.6% or less.

Si: 1.0% or Less

Si is usually used as a deoxidizer in a melting step and is an element that is unavoidably contained in a steel ingot after the casting. However, when the amount of Si is too large, the toughness of the die for warm or hot forging deteriorates. Therefore, Si is 1.0% or less. It is preferably 0.8% or less, and more preferably 0.6% or less. It is further preferably 0.4% or less, and still further preferably 0.2% or less.

Note that Si has a function of making primary carbide spherical and minute during the casting. Therefore, it is preferably 0.05% or more, and more preferably 0.1% or more.

Mn: 1.0% or Less

Similarly to Si, Mn is used as a deoxidizer in the melting step and is an element that is unavoidably contained in the steel ingot after the casting. However, when the amount of Mn is too large, annealing hardness increases, thus deteriorating a machining property (a cutting property) when the steel ingot is machined into the shape of the die for warm or hot forging. Therefore, Mn is 1.0% or less. It is preferably 0.9% or less, and more preferably 0.8% or less. It is further preferably 0.7% or less, and still further preferably 0.6% or less.

Note that Mn has a function of improving a hardening property. Therefore, it is preferably 0.1% or more, and more preferably 0.2% or more. It is further preferably 0.3% or more, and still further preferably 0.4% or more.

Cr: 4.0 to 6.0%

Cr is an element that combines with C and thereby forms carbide, thus improving an abrasion resistance of the die for warm or hot forging. Further, it is also an element that contributes to an improvement in a hardening property. However, when its amount is too large, it causes segregation in the structure and thereby lowers the toughness. Therefore, Cr is 4.0 to 6.0%. It is preferably 5.5% or less, and more preferably 5.0% or less. It is further preferably 4.5% or less.

The Relational Expression of (Mo+½W) Containing One or Both of W and Mo: 2.0 to 4.0%

W and Mo are elements that combine with C and thereby form carbide, and are solid-dissolved in the matrix during the hardening and thereby increase the hardness, thus improving the abrasion resistance of the die for warm or hot forging. However, when the amount is too large, it causes segregation and thereby lowers the toughness of the die. Regarding the above-described functions and effects, the contents of W and Mo can be adjusted according to the relational expression (Mo+½ W). Further, in the present invention, the above-described relational expression is adjusted to 2.0 to 4.0% depending on the amount of one or both of W and Mo. It is preferably 2.2% or more, more preferably 2.4% or more, and further preferably 2.6% or more. Further, it is preferably 3.7% or less, more preferably 3.3% or less, and further preferably 3.0% or less.

Note that as compared to Mo, W has an ability of causing segregation and hence tends to impair the toughness. Therefore, W is preferably 3.0% or less (1.5% or less in the above-described relational expression). It is further preferably 2.0% or less (1.0% or less in the above-described relational expression).

The Relational Expression of (V+Nb) Containing One or Both of V and Nb: 0.5 to 2.5%

V and Nb combine with C and thereby form carbide, thus improving the abrasion resistance and the seizing resistance of the die for warm or hot forging. Further, they are solid-dissolved in the matrix during the hardening and makes minute carbides that are less likely to cling together precipitate during the tempering. Therefore, they improve a softening resistance in a high-temperature environment and impart an excellent high-temperature proof stress. Further, they make crystal grains minute and thereby improve the toughness and a heat-crack resistance. However, when the amount is too large, they produce large carbide particles and thereby cause occurrences of cracks in the die during the warm or hot forging. Regarding the above-described functions and effects, the contents of V and Nb can be adjusted according to the relational expression (V+Nb). Further, the above-described relational expression is adjusted to 0.5 to 2.5% depending on the amount of one or both of V and Nb. It is preferably 0.7% or more, and more preferably 0.9% or more, and further preferably 1.1% or more. Further, it is preferably 2.0% or less, and more preferably 1.8% or less. It is further preferably 1.5% or less, and still further preferably 1.3% or less.

Note that as compared to V, Nb has an excellent softening resistance, an excellent effect of improving the high-temperature strength, and an excellent effect of preventing crystal grains from becoming too large. Therefore, Nb is preferably contained. Further, when Nb is contained, it is preferably 0.02% or more. The upper limit of Nb may be, for example, 0.1% or 0.08%.

Ni: 0 to 1.0%

Ni imparts an excellent hardening property to high-speed tool steel. As a result, it is possible to form a hardened structure mainly composed of martensite and thereby to improve the intrinsic toughness of the matrix itself. Therefore, Ni can be contained as required, though the content thereof may be 0%. However, when the amount of Ni is too large, the annealing hardness increases, thus deteriorating the machining property when the steel ingot is machined into the shape of the die for warm or hot forging. Therefore, even when Ni is contained, the amount thereof is 1.0% or less. It is preferably 0.7% or less, and more preferably 0.5% or less. It is further preferably 0.35% or less, and still further preferably 0.15% or less. Further, when it is contained, it is preferably 0.01% or more. It is more preferably 0.03% or more, and further preferably 0.05% or more.

Co: 0 to 5.0%

Co is an element that improves a softening resistance in a high-temperature environment and is effective in maintaining the high-temperature hardness when the temperature of the die for warm or hot forging in use is raised. Therefore, Co can be contained as required, though the content thereof may be 0%. However, when the amount of Co is too large, the toughness deteriorates. Therefore, even when Co is contained, the amount thereof is 5.0% or less. It is preferably 4.0% or less, and more preferably 3.0% or less. It is further preferably 2.0% or less, and still further preferably 1.0% or less. When it is contained, it is preferably 0.3% or more. It is more preferably 0.4% or more, further preferably 0.5% or more, and still further preferably 0.6% or more.

N (Nitrogen): 0.02% or Less

N is an impurity element unavoidably contained in the steel ingot after the casting. Further, since it is an element having a strong affinity with V and Nb, which are carbide-forming elements, it is an element that forms a large amount of carbonitride and thereby reduces the toughness of the die for warm or hot forging. Further, the carbonitride becomes a starting point of a fracture and hence becomes a factor for causing early cracks in the die for warm or hot forging in use. Therefore, it is important to adjust the amount of N to 0.02% or less. It is preferably 0.018% or less, and more preferably 0.015% or less. Note that an extreme reduction of the content of unavoidably-contained N may become a factor for deteriorating the efficiency of the manufacturing of the raw material. Therefore, the lower limit of the content of N may be, for example, 0.0005%. Alternatively, it may be 0.001%.

Further, S and P may be contained as unavoidable impurity elements in the high-speed tool steel according to the present invention. When the amount of S is too large, it impairs hot workability. Therefore, it is preferably regulated to 0.01% or less. It is more preferably 0.005% or less, and further preferably 0.003% or less. When the amount of P is too large, the toughness deteriorates. Therefore, it is preferably regulated to 0.05% or less. It is more preferably 0.025% or less, and further preferably 0.02% or less.

Hardness: 55 to 60 HRC

Because of the constituent composition of its special matrix high-speed steel, the above-described raw material according to the present invention can maintain excellent toughness even when it is adjusted to high hardness. Further, hardness (Rockwell hardness) of a die for warm or hot forging made of the above-described raw material is adjusted to 55 HRC or higher (at a room temperature). Preferably, it is 56 HRC or higher. By increasing the hardness, it is possible to impart an excellent tensile strength to the die even at a high temperature.

When the hardness of the die for warm or hot forging is excessively increased, the toughness may be excessively lowered. Therefore, it becomes a factor for possibly causing a crack in the die when a stress is suddenly caused in the die when it is used at a high temperature. Therefore, the hardness of the die for warm or hot forging made of the raw material is adjusted to 60 HRC or lower (at a room temperature). Preferably, it is 58 HRC or lower.

Note that the hardness of the die in the present invention can be measured in accordance with a measurement method described in JIS Z 2245 "Rockwell Hardness Test/Test Method", and hence Rockwell C-scale hardness is used.

(2) In the present invention, a steel material is warm-and-hot forged, by using a die for warm or hot forging, by spraying or applying a water-soluble polymer lubricant containing 0.01 to 0.98 mass % of a water-soluble sulfate onto a working surface of the die for warm or hot forging, the die for warm or hot forging including a nitrided layer or a nitrosulfidized layer on the working surface thereof.

Figure 2:
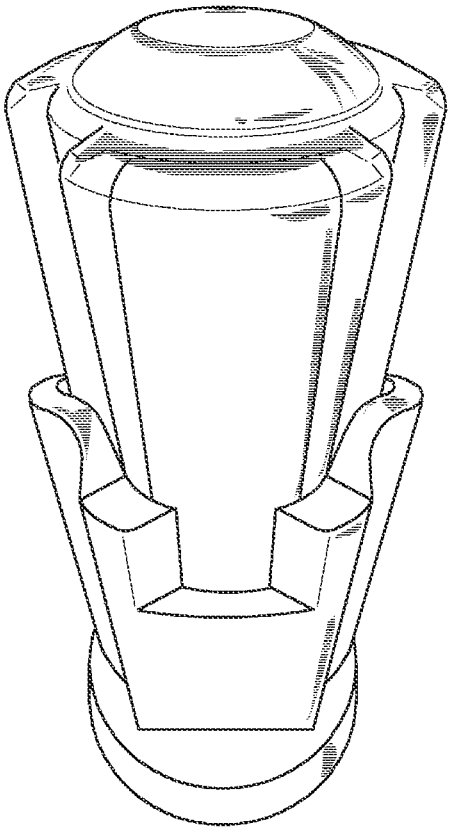
FIG. 2 is a drawing showing an example of an external appearance of a working surface of a die for warm or hot forging after it is used.

In general, in a die for warm or hot forging in which various types of surface treatment layers are formed on its working surface, the working surface exhibits a "dull color" before it is used (FIG. 1). Further, it is known that the working surface of such a die with which a certain number of times of warm or hot forging have been performed but it has not reached its life span yet, i.e., the working surface of the so-called "durable die" exhibits a shiny black color (FIG. 2).

Therefore, firstly, the present inventors analyzed a working surface exhibiting the above-described shiny black color. As a result, it was verified that a layer of iron oxide (Fe—O) having excellent lubricity was formed on the working surface exhibiting the shiny black color. Further, the present inventors have found that: when the composition of the Fe—O layer is "magnetite ($Fe_{3-c}O_{4-d}$)", the lubricity of this magnetite is more excellent than that of hematite ($Fe_{2-a}O_{3-b}$); and therefore, the formation of the magnetite on the working surface of the die during the warm or hot forging improves the durability of the die for warm or hot forging. Note that the atomic ratio between Fe and O is not necessarily a stoichiometric composition ratio. Therefore, they are expressed by using symbols a, b, c and d.

Further, the present inventors evaluated the above-described phenomenon by using a die for warm or hot forging in which "a nitrided layer (including a nitrosulfidized layer)" was formed on its working surface, and verified that, as expected, the working surface of a die having excellent durability exhibited the above-described "shiny black color" and a magnetite layer was formed on its working surface.

Further, the present inventors have found that, owning to the stability of this magnetite layer, it is possible to actively use a lubricant that is sprayed or applied onto the working surface of a die during warm or hot forging, and have achieved an optimum combination of a surface treatment layer and a lubricant according to the present invention.

That is, the lubricant contains an "effective" amount of sulfur that acts on the above-described formation of the magnetite layer. As a result, a sulfur component in the lubricant is supplied to the area between the nitrided layer formed on the working surface of the die for warm or hot forging in use and the material to be processed, and the supplied sulfur component acts as a mechanism for efficiently changing the iron nitride (Fe—N) constituting the nitrided layer into a magnetite layer. Note that it is inferred that the Fe component of the steel material constituting the material to be processed and the Fe component of the raw material constituting the die also contribute to this mechanism, and the main substance that contributes the mechanism is the one constituting the material to be processed. Further, regarding the "effective" amount of sulfur to enable this mechanism to work, it is impractical to make the lubricant contain sulfur itself. However, it is possible to make the lubricant contain a considerable amount of sulfur by making the lubricant contain it in the form of water-soluble sulfate, and to expedite the above-described formation of the magnetite layer.

Figure 4:
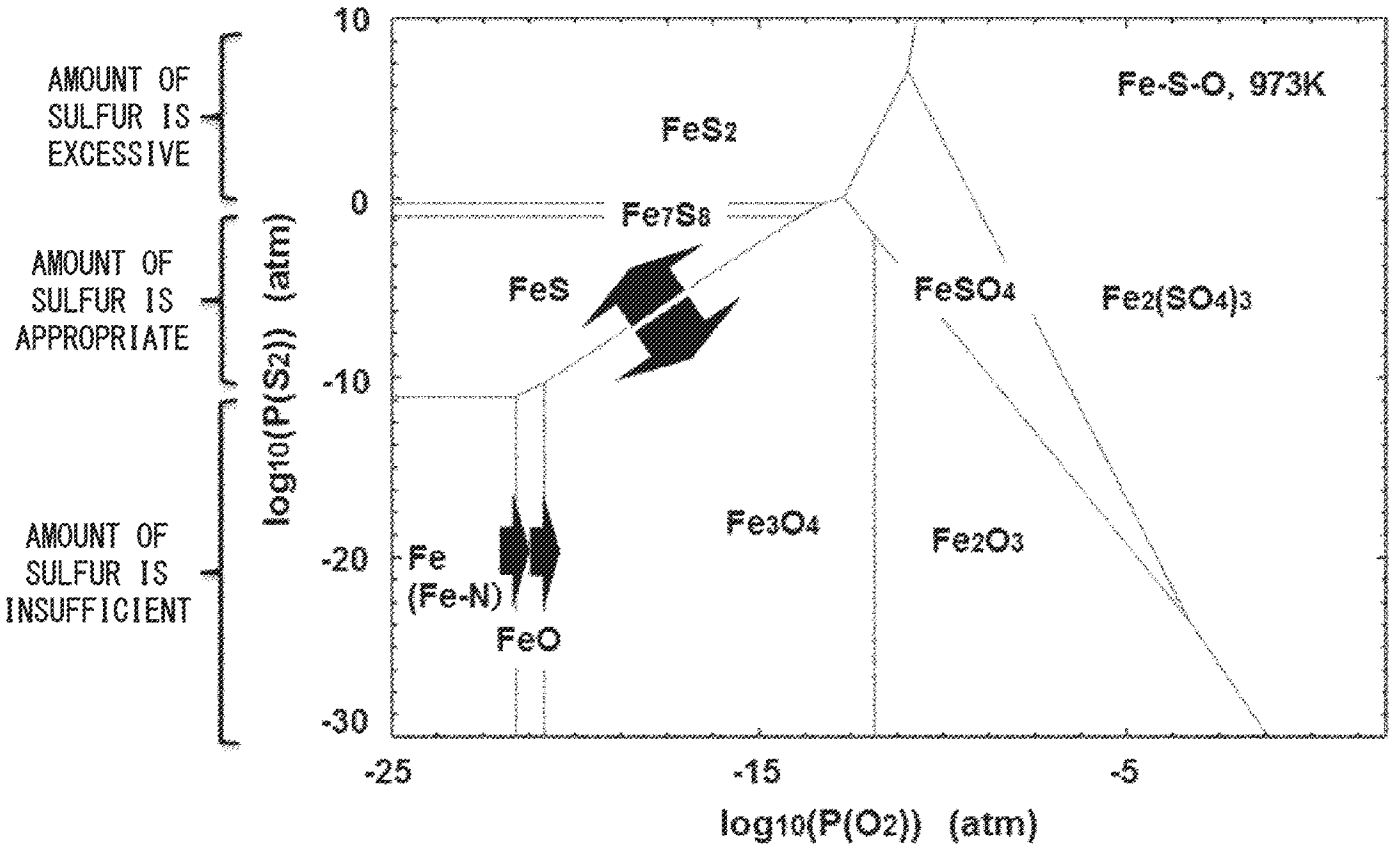
FIG. 4 is an Fe—S—O composition phase diagram on a working surface of a die for warm or hot forging in use, for explaining a mechanism for forming magnetite on the working surface.

It is inferred that the mechanism for forming a magnetite layer works as described below. FIG. 4 is a Fe—S—O composition phase diagram on a working surface (700° C.) of a die for warm or hot forging in use. A horizontal axis indicates the partial pressure of oxygen in a working-surface environment, in which the partial pressure $P(O_2)$ of oxygen is expressed as $\log_{10}(P(O_2))$. Further, a vertical axis indicates the partial pressure of sulfur in a working-surface environment, in which the partial pressure $P(S_2)$ of sulfur is expressed as $\log_{10}(P(S_2))$. Although each of the partial pressures fluctuates during the use, it is possible to roughly understand the environment on the working surface (the process of the reaction) during the use from this phase diagram.

In order to increase the life span of the die for warm or hot forging, it is effective to form a magnetite layer having excellent lubricity on the working surface quickly and uniformly from the start of the use of the die. Further, the inventors have found that, for this effective formation of the magnetite layer, it is effective to arrange an environment by which Fe—N constituting the nitrided layer and Fe in the material to be processed are changed to magnetite ($Fe_{3-c}O_{4-d}$) through a chemical form of FeS (iron(II) sulfide) by adjusting the amount of sulfur in the lubricant.

When the Amount of Sulfur in the Lubricant is Insufficient

Firstly, when the amount of sulfur in the lubricant is insufficient, the partial pressure of sulfur in the working-surface environment falls. Therefore, as shown in FIG. 4, Fe—N in the nitrided layer is oxidized and changed into FeO (wustite). Even this FeO can be changed into magnetite. However, the change of wustite into magnetite under such a use environment depends on the diffusing speed of oxygen in the wustite, so that the change is slow. Further, wustite is a brittle substance, and in particular a brittle oxide when the temperature is low (e.g., at 600° C. or lower). Therefore, when the temperature of the working surface is not high after the die starts to be used, wustite that has not changed into magnetite crumbles and becomes an abrasive powder. The abrasive powder rubs the working surface of the die, thus causing ternary abrasive abrasion thereon and preventing the life span of the die for warm or hot forging from bend increased.

When the Amount of Sulfur in the Lubricant is Appropriate

Therefore, when the amount of sulfur in the lubricant is increased to an appropriate amount, the partial pressure of sulfur in the working-surface environment is adjusted as appropriate. Therefore, as shown in FIG. 4, Fe—N in the nitrided layer and Fe in the material to be processed are changed into FeS. Further, since FeS can coexist with $Fe_{3-c}O_{4-d}$, the above-described FeS can be easily changed into magnetite. Further, regarding this change, it is theoretically possible to carry out the change without generating the above-described FeO during the change. Therefore, it is possible, from the start of the use of the die for warm or hot forging subjected to the nitriding treatment, to form a magnetite layer having excellent lubricity uniformly and rapidly on the working surface of the die for warm or hot forging without generating wustite. Therefore, it is possible to suppress the generation of frictional heat on the working surface of the die in used, suppress the ternary abrasive abrasion thereon, and achieve the increased life space of the die for warm or hot forging.

When the Amount of Sulfur in the Lubricant is Excessive

However, when the amount of sulfur in the lubricant is too large, the partial pressure of sulfur in the working-surface environment excessively rises. Therefore, as shown in FIG. 4, Fe—N in the nitrided layer and Fe in the material to be processed change into a chemical form of $FeS_2$ (iron disulfide) and $Fe_7S_8$. Further, $FeS_2$ and $Fe_7S_8$ can hardly coexist with magnetite ($Fe_{3-c}O_{4-d}$). Further, even if these iron sulfides can be changed into magnetite, the change requires the change of FeS. Therefore, a sufficient magnetite layer is not formed on the working surface of the die for warm or hot forging in use (because the magnetite layer disappears). Therefore, it cannot be expected to obtain the effect of improving the life span of the die for warm or hot forging. Alternatively, even if the magnetite layer is formed on the working surface, the formation of the magnetite layer is not sufficient when it is desirable to reduce the forming load in the early stage of the warm or hot forging. Therefore, the effect of improving the life span of the die for warm or hot forging is small. When the partial pressure of sulfur in the working-surface environment is high, noticeable abrasion may occur due to the seizing and hence the life span of the die may be extremely shortened.

As described above, in the method for manufacturing a forged article according to the present invention, the above-described water-soluble polymer lubricant used in the method contains 0.01 to 0.98 mass % of a water-soluble sulfate. When the content of the water-soluble sulfate is too small, there is a concern for the occurrence of ternary abrasive abrasion due to the generation of wustite and hence the above-described function of forming a magnetite layer cannot be obtained. It is preferably 0.03 mass % or more. Further, it is possible to expedite the rapid formation of the magnetite layer by adjusting the content of the water-soluble sulfate to 0.98 mass % or less, and thereby to obtain the effect of improving the life span of the die from the early stage of the warm or hot forging. Further, the corrosion of the forging equipment is suppressed and the occurrence of a bad odor due to the combustion of sulfur is also suppressed, so that the working environment is improved. It is preferably 0.70 mass % or less, more preferably 0.50 mass % or less, further preferably 0.30 mass % or less, and still further preferably 0.10 mass % or less. Note that when the lubricant is diluted when it is used, the content of the water-soluble sulfate is adjusted so that the content in the diluted lubricant becomes 0.01 to 0.98 mass %.

The above-described water-soluble sulfate can be selected as appropriate from sulfates that can be dissociated in water. For example, one or more sulfates can be selected from lithium sulfate, sodium sulfate, potassium sulfate, rubidium sulfate, magnesium sulfate, aluminum sulfate, and zinc sulfate.

A water-soluble polymer lubricant is used as the lubricant in which the water-soluble sulfate is contained. The water-soluble polymer lubricant is suitable as a lubricant for warm or hot forging because it has excellent adhesion to the working surface of the die at a high temperature and also has excellent lubricity. Further, the water-soluble polymer lubricant can be selected as appropriate from known water-soluble polymer lubricants. In addition, any water-soluble polymer lubricant that can be used as a lubricant for warm or hot forging can be used as the above-described water-soluble polymer lubricant.

In the present invention, the water-soluble polymer lubricant is a water-based lubricant containing at least a water-soluble polymer and a water-soluble sulfate, and, if necessary, may also contain other components.

The water-soluble polymer is used to make components in the lubricant adhere to the surface of the die and thereby to form a robust lubricant film. The water-soluble polymer may be any polymer compound having a water-soluble substituent and may be selected as appropriate from known polymer compounds. Examples of the water-soluble substituent include acidic groups such as a carboxyl group and a sulfo group, basic groups such as an amino group, and hydroxyl groups.

Specific examples of the water-soluble polymer include polyacrylic acid, an acrylic acid-maleic anhydride copolymer, carboxymethyl cellulose, an isobutylene-maleic anhydride copolymer, and a methyl vinyl ether-maleic anhydride copolymer. Further, only one type of a water-soluble polymer may be used, or two or more types of water-soluble polymers may be used in combination.

The ratio of the content of the water-soluble polymer in the water-soluble polymer lubricant is preferably 1 mass % to 30 mass % based on the total amount, i.e., 100 mass % of the water-soluble polymer lubricant including water.

Further, if necessary, the water-soluble polymer lubricant may also contain, for example, a carboxylic acid compound for reducing friction between the die and the steel material, i.e., the material to be processed, and/or an anticorrosive additive or a chelating agent for suppressing corrosion in the forging equipment. The carboxylic acid compound, the anticorrosive additive, and the chelating agent can be selected as appropriate from known compounds and agents.

(3) The present invention preferably provides one in which a nitrided layer or a nitrosulfidized layer on a working surface is formed by a salt-bath method.

The method for forming a nitrided layer or a nitrosulfidized layer on the working surface of a die can be selected as appropriate from known methods. For the formation of the nitrided layer, an ordinary nitriding treatment method can be applied. Its examples include various nitriding treatment methods such as a plasma nitriding method, a gas nitriding method, and a salt-bath nitriding method. For example, in the case of the plasma nitriding treatment, a mixed gas of nitrogen and hydrogen is used as a source gas, and the nitriding treatment can be performed at a temperature of about 400 to 560° C. Further, as for the formation of the nitrosulfidized layer, examples include a nitrosulfidizing treatment disclosed in Patent Literature 1, a salt-bath nitrosulfidizing treatment disclosed in Patent Literature 2, and a gas nitrosulfidizing treatment method disclosed in Japanese Unexamined Patent Application Publication No. 2001-316795. The salt-bath nitriding treatment is a surface treatment method using, as a treatment medium, a salt bath in which a sulfide is added to a base salt including a nitriding source, in which the material to be processed is submerged in the salt bath containing NaCl, KCNO, $CaCN_2$, NaCNO and the like as main components and can be treated at a temperature of 500 to 600° C. In the case of the gas nitrosulfidizing treatment, the nitriding treatment can be performed at a temperature of about 400 to 580° C. in a mixed atmosphere of a nitriding gas containing ammonia and hydrogen sulfide and a sulfurizing gas.

The depth of the layer in the nitrided layer or the nitrosulfidized layer is not limited to any particular depths, but is preferably 0.05 mm to 0.5 mm in order to improve the durability of the die. Further, it is more preferably 0.1 mm or longer. Further, it is more preferably 0.3 mm or shorter.

By combining the above-described water-soluble polymer lubricant containing an appropriate amount of water-soluble sulfate with the surface treatment layer (the nitrided layer or the nitrosulfidized layer) formed on the working surface of the die for warm or hot forging by the above-described surface treatment method, the working surface of the die in use is covered by a layer exhibiting a "shiny black color" (i.e., a magnetite layer) over a long period of use, thus providing an effect of suppressing abrasion on the working surface. However, even in such a mechanism for forming a magnetite layer, when the die is used for a longer period of time, the nitrided layer itself (or the nitrosulfidized layer itself), which is the source for forming the magnetite layer and also maintains the strength of the working surface, is thermally decomposed gradually and eventually reaches the life span of the die for warm or hot forging due to the abrasion.

To cope with this, it is possible to improve the heat resistance (the high-temperature strength) of the surface treatment layer by forming the surface treatment layer on the working surface by using a "salt-bath method". By doing so, it is possible to delay the thermal decomposition of the surface treatment layer. Further, it is also possible to suppress the deterioration of the hardness of the raw material of the die for warm or hot forging due to the softening during the use of the die.

Further, in particular, it is possible, by forming the surface treatment layer of the working surface by the salt-bath method, to impart a "residual compressive stress" to the surface treatment layer. Further, since this residual compressive stress is unlikely to be released even in the state of the die that is used under a high-temperature environment, it is possible to prevent cracks from forming and from growing on the working surface even when the die is used for a long time. Note that the above-described residual compressive stress is preferably distributed in the vicinity of the surface of the die. Further, it is preferable that a large compressive residual stress of −400 MPa or weaker is imparted at a place having a depth of 30 μm (0.03 mm) from the working surface of the die on which the surface treatment layer is formed ("− (minus)" indicates that it is a compressive stress). It is more preferably −500 MPa or lower, and further preferably −600 MPa or lower. Note that it is unnecessary to set a lower limit for this value (an upper limit for an absolute value thereof). Further, its realistic value is about −1,000 MPa.

Further, when the "nitrosulfidized layer" is selected as the surface treatment layer, the formation of the nitrosulfidized layer by the salt-bath method is also effective because the partial pressure of sulfur on the working surface of the die in use can be easily adjusted. As described above, when the partial pressure of sulfur in the working-surface environment of the die in use excessively rises, Fe—N in the nitrided layer and Fe in the material to be processed are unlikely to change into magnetite. Therefore, the salt-bath nitrosulfidized layer is more preferred than the gas nitrosulfidized layer and the like are because the amount (the thickness) of the Fe—S layer present therein can be reduced and the rise of the partial pressure of sulfur in the working-surface environment that is optimized by adjusting the amount of sulfur in the lubricant can be suppressed.

Method for Manufacturing Forged Article

An example of a method for warm or hot forging a steel material by spraying or applying a water-soluble polymer lubricant onto the working surface of a die will be described hereinafter with reference to FIG. 3.

Figure 3:
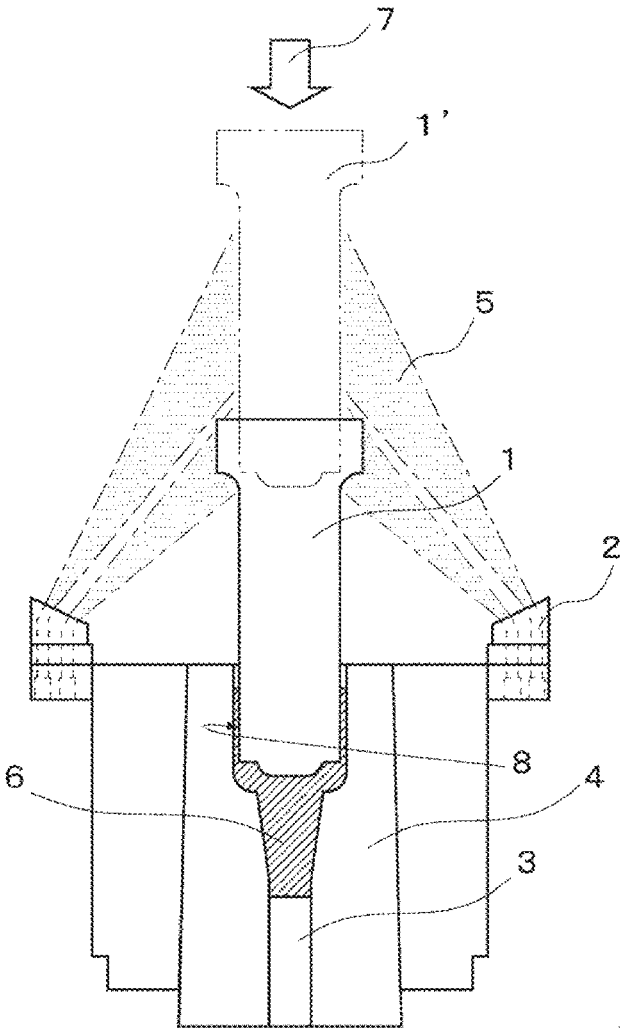
FIG. 3 is a schematic cross-sectional view showing an example of forging equipment.

FIG. 3 is a schematic cross-sectional view showing an example of forging equipment. The punching dies 1' and 1 in FIG. 3 represent a state before pressing and a state during the pressing, respectively, and are the one and same punch die. In the example shown in FIG. 3, the forging equipment includes the punching die 1, a die 4, and splaying ports 2 used for spraying a water-soluble polymer lubricant 5. A cavity 3 is formed by the combination of the punching die 1 and the die 4.

In the example shown in FIG. 3, a water-soluble polymer lubricant is sprayed or applied onto the working surface of the die 4 and, after that, a steel material 6, which is the material to be processed, is disposed. Then, the water-soluble polymer lubricant 5 is sprayed from the splaying ports 2 onto the working surface 8 of the punching die 1' that has not been pressed yet. Next, the punching die 1 is pressed in a pressing direction indicated by an arrow 7 in FIG. 3 by the operation of the pressing machine, and a forged article made of the steel material 6 is manufactured through backward extrusion processing. The steel material, which eventually becomes a forged article, can be selected as appropriate from stainless steel and carbon steel usable for forging according to the use of the forged article and the like.

Note that the forging equipment typically includes a forging pressing machine (not shown). Further, there are no particular limitations on the rest of the configuration and any known configuration can be used therefor.

In the present invention, regarding the timing of spraying or applying a water-soluble polymer lubricant containing a water-soluble sulfate onto the working surface of a die for warm or hot forging, the spraying or applying may be performed onto the working surface of the die for warm or hot forging separated from the material to be processed every time the warm or hot forging is completed once or completed twice or more. Further, it is preferably performed every time the warm or hot forging is completed once, so that an effect of the lubricant as a releasing agent can also be obtained.

Further, the working surface of the die for warm or hot forging at the time of the above-described spraying or applying of the water-soluble polymer lubricant containing the water-soluble sulfate is preferably preheated to 150 to 400° C. It is more preferably 300° C. or lower. Further, in particular, the working surface is preferably preheated from the start of the first warm or hot forging. The preheating of the working surface to the aforementioned temperature is effective for forming an excellent magnetite layer on the working surface of the die from the early stage of the warm or hot forging, and also effective for reducing the forming load.

Example

A component for a constant-velocity joint was manufactured by performing warm or hot forging for a steel material S45C (JIS G 4051) by using a punching die (a die) having the shape shown in FIG. 1. Note that the raw material of the punching die had a constituent composition shown in Table 1, and its hardness was adjusted to 57 HRC through hardening and tempering.

TABLE 1

| Constituent Composition (mass %) | | | | | | | | | | | |
|---|---|---|---|---|---|---|---|---|---|---|---|
| C | Si | Mn | Ni | Cr | W | Mo | V | Co | Nb | N | Fe* |
| 0.53 | 0.15 | 0.45 | 0.10 | 4.14 | 1.56 | 1.96 | 1.16 | 0.78 | 0.06 | 0.0130 | Bal. |

*Including impurities (P: 0.019%, S: 0.0005%, etc.)

Further, various types of surface treatment layers were formed on the working surface of the punching die by surface treatments 1 to 3 shown below.

Surface Treatment 1

A nitrosulfidized layer in which the depth of a nitrided layer (a diffusion layer) was about 0.20 mm was formed by a salt-bath nitrosulfidizing treatment (Processing temperature: 580° C., Processing time: 4 hours) (FIG. 1).

Surface Treatment 2

A nitrosulfidized layer in which the depth of the layer (a diffusion layer) was about 0.15 mm was formed by a gas nitrosulfidizing treatment (Processing temperature: 500° C., Processing time: 5 hours).

Surface Treatment 3

A nitrided layer in which the depth of the layer (a diffusion layer) was about 0.10 mm was formed by a plasma nitrosulfidizing treatment (Processing temperature: 510° C., Processing time: 6 hours).

Figure 5:
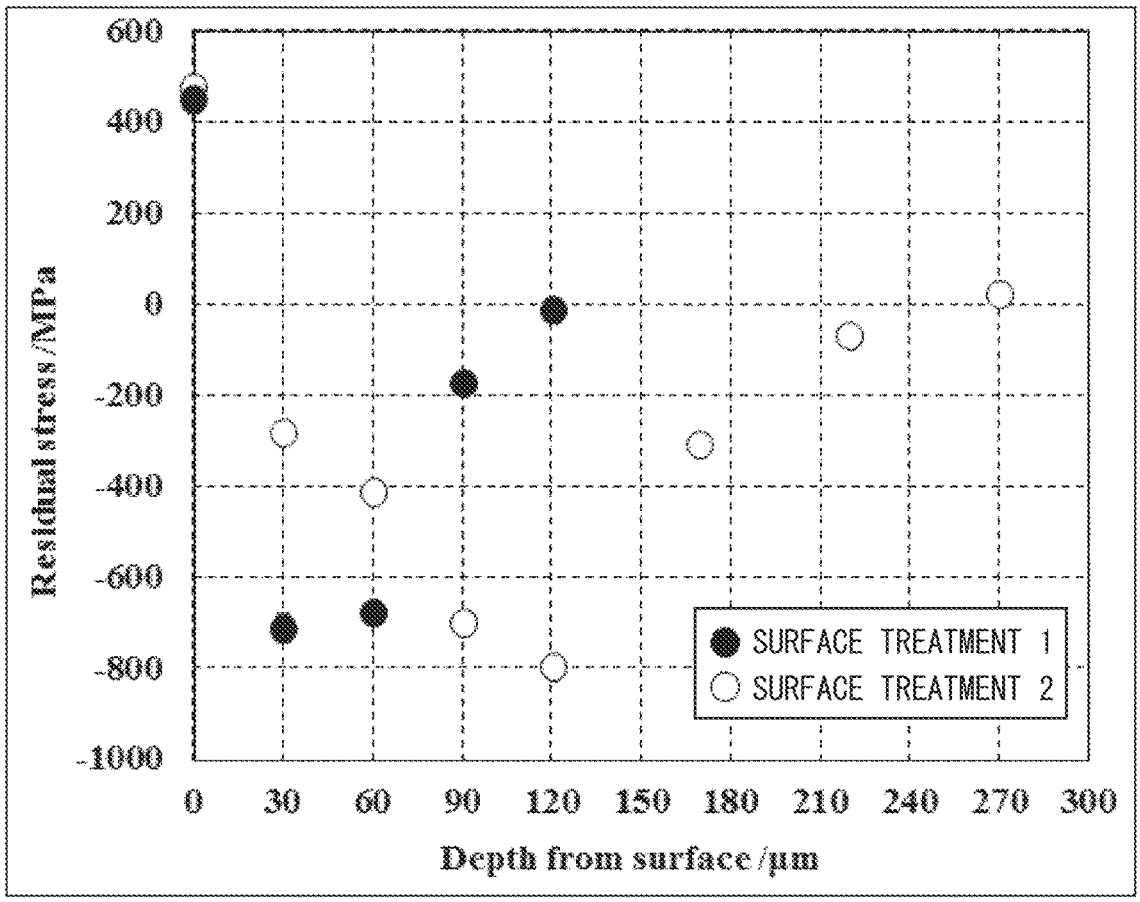
FIG. 5 shows a distribution of residual stresses in a depth direction from the working surface of a die after a surface treatment is performed.

Note that regarding the nitrosulfidizing treatment for the surface treatments 1 and 2, a distribution of residual stresses in a depth direction from a surface-treated surface (a surface-treated working surface) of a test piece made of the above-described raw material was measured. The measurement was X-ray stress measurement, and a (103) plane of $Fe_3N$ was used as a diffraction line. Further, a distribution of residual stresses of the surface-treated test piece was also measured after it was heated to 600° C. A (211) plane of α-Fe was used as the diffraction line used in the measurement. FIG. 5 (after the surface treatment) and FIG. 6 (after the heating) show respective results. A vertical axis indicates the residual stress (MPa, "− (minus)" indicates a compressive stress), and a horizontal axis indicates the depth from the surface (μm).

Figure 6:
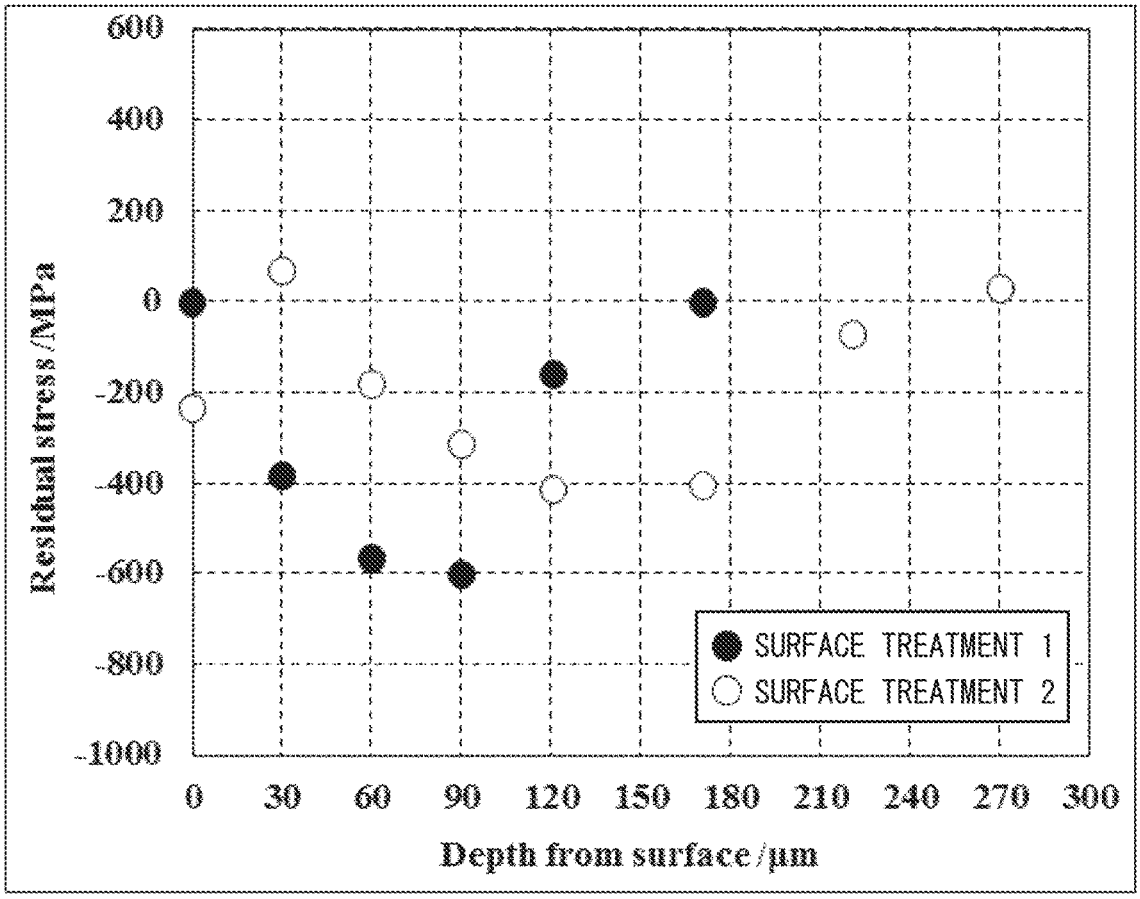

FIG. 5 shows that in the salt-bath nitrosulfidizing treatment (the surface treatment 1), a large compressive residual stress was imparted at a place closer to the surface as compared to the place in the gas nitrosulfidizing treatment (the surface Treatment 2). Further, a compressive residual stress as strong as −700 MPa was imparted at a depth of 30 μm from the surface. Further, as shown in FIG. 6, this compressive residual stress is unlikely to be released even after the heating, and maintains a value that is effective to prevent cracks from forming and from growing on the working surface.

Actual warm or hot forging was performed by using the manufactured punching die. Firstly, a lubricant was splayed onto the working surface of the punching die preheated to 200° C. by using a spray, and warm or hot forging for molding a steel material heated to 700 to 1,000° C. was performed. Then, after that, every time warm or hot forging was completed once, warm or hot forging in which the lubricant was sprayed onto the working surface of the punching die separated from the steel material, which is the material to be forged, was repeated. Further, the number of times of forging until the nitrosulfidized layer on the working surface was exhausted and hence the die reached its life span was measured. Note that as the aforementioned lubricant, one that was obtained by diluting a commercially-available water-soluble polymer lubricant "Hot Aqualub 300TK (Manufactured by Daido Chemical Industry, Co., Ltd.)" with an amount of water four times as larger as that of the water-soluble polymer lubricant. Then, for the diluted lubricant, warm or hot forging was performed under two different conditions, i.e., a condition in which the diluted lubricant, which referred to as a "lubricant A", was used as it was and a condition in which 0.06 mass % of sodium sulfate was added in the diluted lubricant, which referred to as a "lubricant B", was used. Table 2 shows results of the life span of the die (the above-described number of times of forging). (A result of a combination of the surface treatment 3 and the lubricant A is defined as "100")

TABLE 2

| Surface Treatment | Lubricant | Life span of die | Remarks |
|---|---|---|---|
| 1 (Salt-bath nitrosulfidizing) | B (Containing sodium sulfate) | 164 | Examples according to present invention |
| 2 (Gas nitrosulfidizing) | | 115 | |
| 3 (Plasma nitriding) | | 137 | |
| 1 (Salt-bath nitrosulfidizing) | A | 66 | Comparative examples |
| 3 (Plasma nitriding) | | 100 | |

As a result of the warm or hot forging, in the warm or hot forging using the lubricant B, a magnetite layer formed on the working surface of the die was stabilized, and hence the durability of the nitrided layer or the nitrosulfidized layer was improved (FIG. 2 shows the working surface of the die in which the surface treatment 1 was applied). Further, the life span of the die was improved by about two times or more as compared to the combination of the salt-bath nitrosulfidizing and the lubricant A.

This application is based upon and claims the benefit of priority from Japanese patent application No. 2018-097711, filed on May 22, 2018, the disclosure of which is incorporated herein in its entirety by reference.

REFERENCE SIGNS LIST

1' PUNCH (BEFORE PRESSING)
1 PUNCH (DURING PRESSING)
2 SPLAYING PORT
3 CAVITY
4 DIE
5 WATER-SOLUBLE POLYMER LUBRICANT
6 STEEL MATERIAL (MATERIAL TO BE PROCESSED)
7 PRESSING
8 WORKING SURFACE

The invention claimed is:

1. A method for manufacturing a forged article, including warm or hot forging a steel material, by using a die, by spraying or applying a water-soluble polymer lubricant containing 0.01 to 0.98 mass % of a water-soluble sulfate onto a working surface of the die, the die being made of a raw material having a constituent composition of, by mass %, 0.4 to 0.7% of C, 1.0% or less of Si, 1.0% or less of Mn, 4.0 to 6.0% of Cr, 2.0 to 4.0% of a relational expression of (Mo+½W) containing one or both of W and Mo, 0.5 to 2.5% of a relational expression of (V+Nb) containing one or both of V and Nb, 0 to 1.0% of Ni, 0 to 5.0% of Co, 0.02% or less of N, and a remnant composed of Fe and impurities, and having hardness of 55 to 60 HRC, and the die including a nitrided layer or a nitrosulfidized layer on the working surface thereof.

2. The method for manufacturing a forged article according to claim 1, wherein the nitrided layer or the nitrosulfidized layer on the working surface of the die is formed by a salt-bath method.

3. The method for manufacturing a forged article according to claim 1, wherein a compressive residual stress of −400 MPa or weaker is applied to a part of the die located at a depth of 30 μm from the working surface.

4. The method for manufacturing a forged article according to claim 1, wherein the water-soluble polymer lubricant is sprayed or applied onto the working surface of the die preheated to 150 to 400° C.

* * * * *